United States Patent [19]

Culver

[11] 4,098,329

[45] Jul. 4, 1978

[54] MODULAR HEAT EXCHANGER

[75] Inventor: Donald W. Culver, Poway, Calif.

[73] Assignee: The United States of America as represented by the United States Department of Energy, Washington, D.C.

[21] Appl. No.: 709,787

[22] Filed: Jul. 29, 1976

[51] Int. Cl.[2] ..... F28D 7/10

[52] U.S. Cl. ..... 165/140; 165/158; 122/32; 176/65

[58] Field of Search ..... 165/157–160, 165/163, 136, 140, 145; 122/32, 34; 176/60, 65

[56] References Cited

U.S. PATENT DOCUMENTS

| | | | |
|---|---|---|---|
| 3,227,142 | 1/1966 | Bell et al. | 122/34 |
| 3,250,258 | 5/1966 | Heathcote | 122/34 |
| 3,406,747 | 10/1968 | White | 165/157 |
| 3,882,933 | 5/1975 | Kube | 165/163 |

FOREIGN PATENT DOCUMENTS

| | | | |
|---|---|---|---|
| 375,030 | 3/1964 | Switzerland | 165/157 |

*Primary Examiner*—Charles J. Myhre
*Assistant Examiner*—Theophil W. Streule, Jr.
*Attorney, Agent, or Firm*—Dean E. Carlson; Roger S. Gaither

[57] ABSTRACT

A heat exchanger for use in nuclear reactors includes a heat exchange tube bundle formed from similar modules each having a hexagonal shroud containing a large number of thermally conductive tubes which are connected with inlet and outlet headers at opposite ends of each module, the respective headers being adapted for interconnection with suitable inlet and outlet manifold means. In order to adapt the heat exchanger for operation in a high temperature and high pressure environment and to provide access to all tube ports at opposite ends of the tube bundle, a spherical tube sheet is arranged in sealed relation across the chamber with an elongated duct extending outwardly therefrom to provide manifold means for interconnection with the opposite end of the tube bundle.

16 Claims, 4 Drawing Figures

MODULAR HEAT EXCHANGER

BACKGROUND OF THE INVENTION

The present invention relates to heat exchangers and more particularly to a heat exchanger adapted for use in a high temperature and high pressure environment encountered for example in nuclear reactors. The present invention is also particularly directed toward a heat exchanger of a type having a heat exchange tube bundle formed from similar modules. The invention described herein was made in the course of or under a contract with the United States Energy Research and Development Administration.

Heat exchangers of the type contemplated by the present invention are employed in numerous applications for establishing heat exchange contact between physically separated fluids. Within such applications, a relatively high temperature primary fluid is circulated between the heat exchanger and a source of heat with a relatively low temperature secondary fluid being circulated through the heat exchanger for removing heat therefrom.

The primary and secondary fluids which are circulated through the heat exchanger may be either gases or liquids. The heat exchanger contemplated by the present invention is particularly adapted for use with gases such as helium which is commonly employed for circulation through the reactor core of high temperature gas cooled reactors. The helium circulated through the nuclear core may be considered as the relatively high temperature primary fluid. Within such reactor applications, the primary helium experiences the conditions of both very high temperature and very high pressure. Furthermore, since the primary helium fluid is circulated through the reactor core, it is also necessary to assure containment of the fluid within the reactor while avoiding its escape into the surrounding environment or auxiliary systems associted with the reactor.

At the same time, it is necessary to provide an efficient heat exchanger arrangement whereby a large contact surface area is made available for the transfer of heat from the primary fluid to the secondary fluid. This is normally accomplished with a tube bundle wherein the primary fluid may be circulated on the shell side of the bundle with the secondary fluid being circulated through the tubes. It is of course necessary within such an arrangement to provide a means for circulating the secondary fluid into and out of the tube bundle under the high temperature and pressure conditions noted above.

It is particularly important to assure complete separation between the primary and secondary fluids in the area of the tube bundle. This is difficult because of the large number of tubes and the need for forming continuous weld joints or the like at each end of each tube. Construction of the tube bundle with integral connections for the tubes to both inlet and outlet manifold means must also be performed efficiently in order to permit operating economy for the heat exchanger either within a nuclear reactor or in other applications. At the same time, at least within a nuclear reactor application, it is also desirable to be able to selectively block selected portions of the tube bundle. In the past, it has generally been necessary to exhaust the primary fluid from the reactor before access could be obtained to both the inlet and outlet manifold connections for the tube bundle.

Finally, it is important within such heat exchanger applications that the tube bundle and other components of the heat exchanger be capable of compact arrangement within regions of limited space and access. Within a nuclear reactor, the heat exchanger may be arranged within a cylindrical chamber where access is only available to the chamber from one end. Accordingly, it is desirable that both inlet and outlet means for the secondary fluid be arranged in one end of the chamber along with means for permitting access to the tube bundle, particularly the manifold means at each end thereof.

Accordingly, there has been found to remain a need for a heat exchanger including means for overcoming one or more problems of the type described above.

SUMMARY OF THE INVENTION

It is therefore an object of the invention to provide a heat exchanger having a tube bundle formed from a large number of similar modules which can be readily stacked into a clustered assembly to form the tube bundle for the heat exchanger.

It is a related object of the invention to provide a heat exchanger module capable of prefabricated assembly wherein a plurality of similar modules may be arranged in a clustered assembly to form a tube bundle for a heat exchanger.

It is a further object of the invention to provide such a heat exchanger module and a heat exchanger tube bundle formed from a large number of such modules wherein each module has a hexagonal shape in cross-section to facilitate a closely packed arrangement of the modules in a clustered assembly.

It is an even more particular object of the invention to provide such a module including a multiplicity of tubes extending through the length of the module with inlet and outlet header means at opposite ends of the module to facilitate interconnection of a number of such modules with suitable inlet and outlet manifold means.

It is another object of the invention to provide a compact heat exchanger capable of operation under high temperature conditions wherein a tube bundle is arranged about a central duct comprising a portion of the structural support for the tube bundle, the central duct being secured at one end within a heat exchanger chamber and being unsupported at the other end to accommodate expansion and contraction of the center duct and the tube bundle, the center duct providing communication with one end of the tubes in the tube bundle.

It is a more specific object of the invention to provide such a heat exchanger wherein the tubes within the tube bundles are formed as similar modules each including a number of tubes and having a hexagonal shape in cross-section to facilitate their arrangement into a clustered assembly about the center duct.

Yet another object of the invention is to provide a heat exchanger within a cylindrical chamber for receiving a high pressure, high temperature fluid while permitting access to tube ports establishing manifold connections with opposite ends of a tube bundle, a tube sheet providing a manifold connection at one end of the tube bundle being formed in a spherical configuration and arranged at one end of the cylindrical chamber to separate primary and secondary fluids therein, a tube sheet providing a similar manifold connection at the other end of the tube bundle being formed at the end of a relatively large center duct penetrating the spherical tube sheet and extending through the cylindrical chamber.

Additional objects and advantages of the invention are made apparent in the following description having reference to the accompanying drawings.

DESCRIPTION OF THE PREFERRED EMBODIMENT

As indicated above, a heat exchanger constructed according to the present invention is particularly contemplated for use in a nuclear reactor. Within such an application, the heat exchanger is exposed both to extremely high temperatures and pressures while being intended to remain in reliable operation over extended periods of time. It will be obvious from the following description that the present heat exchanger may also be employed in other applications. However, within a nuclear reactor environment as outlined above, the heat exchanger preferably serves an intermediate heat exchanger function wherein a primary fluid, preferably helium, is circulated through the reactor core of a high temperature gas cooled reactor. The primary helium is circulated through such an intermediate heat exchanger for transferring heat to a secondary fluid, again preferably helium, which serves to remove heat or energy away from the heat exchanger. Obviously, either the primary or secondary fluid could be another gas other than helium or even a liquid depending upon the particular application.

Within the nuclear reactor environment described above, the intermediate heat exchanger is arranged closely adjacent the reactor core with circulation of the primary helium being limited to the reactor core and the heat exchanger to prevent contamination of the reactor environment or systems more remote from the reactor core. The secondary fluid, which is not exposed to the reactor core, may thus be employed for transferring heat or energy to systems such as turbines or the like which are relatively remote from the reactor core.

Within such a system, the primary fluid or helium may be delivered to the heat exchanger at an exemplary temperature in the range of approximately 1000° C and a pressure of approximately 700–750 psi absolute. Under exemplary operating conditions, it is contemplated that the primary fluid or helium exits the heat exchanger at a temperature of approximately 500° C for example with a secondary fluid comprised of helium entering the heat exchanger at approximately 400° C and exiting the heat exchanger at approximately 900° C. The secondary fluid or helium is maintained under a slightly higher pressure within the heat exchanger than the primary helium in order to assist in complete confinement of the primary helium to a loop including the reactor core and the present intermediate heat exchanger.

Figure 1:
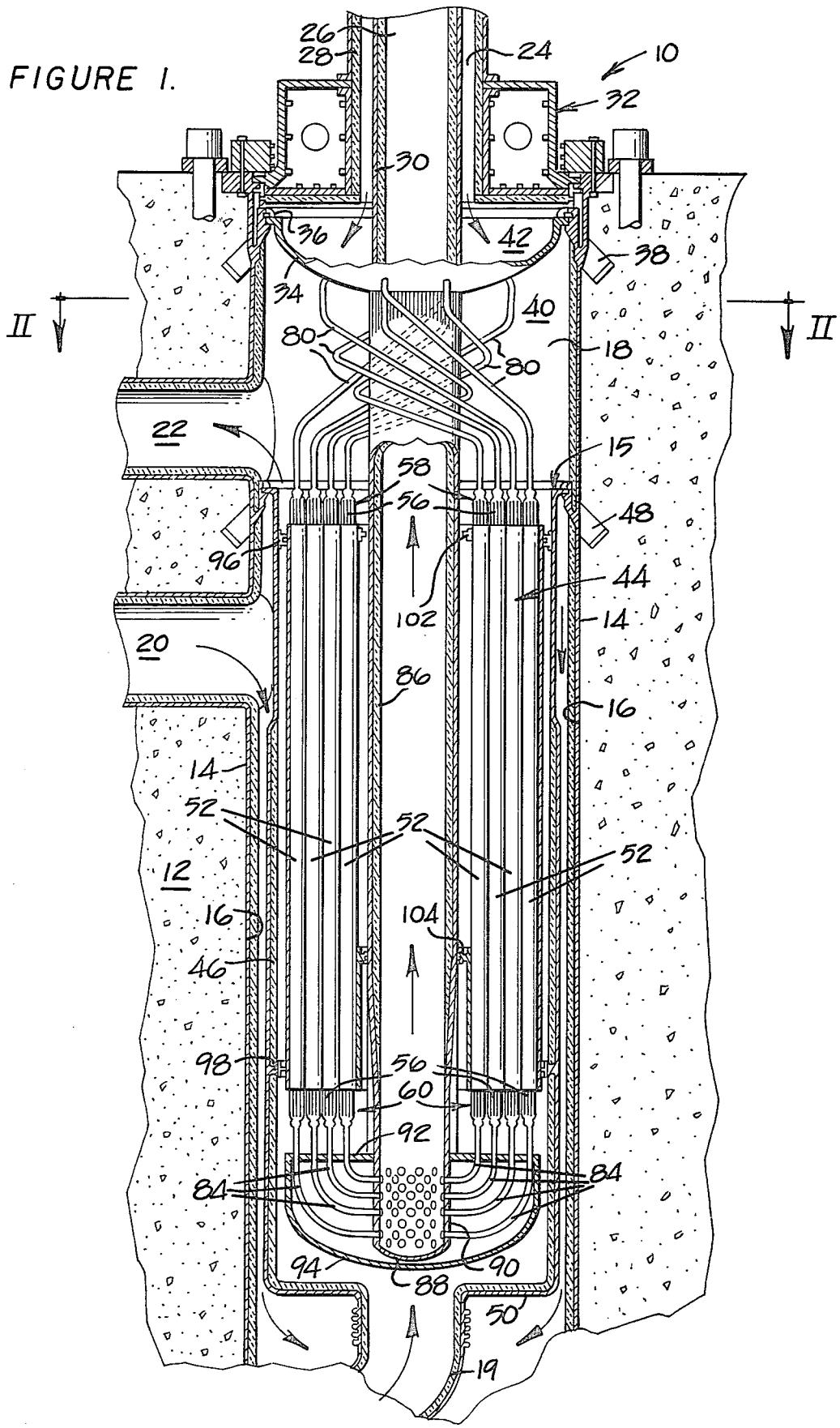
FIG. 1 is a centrally sectioned view of a heat exchanger constructed according to the present invention and arranged within a cylindrical chamber formed as part of a nuclear reactor.

Referring now to the drawings and particularly to FIG. 1, such a heat exchanger is generally indicated at 10 and preferably forms a portion of a nuclear reactor, a portion of a vessel for the reactor being indicated at 12. The heat exchanger 10 is arranged within a cylindrical liner 14 which is turn is mounted within an elongated opening or penetration 16 in the vessel 12. The cylindrical liner 14 thus forms an elongated cylindrical chamber 18 for housing the various components of the heat exchanger 10.

The chamber 18 is divided into two portions 40 and 42 by a spherical tube sheet 34 which is intimately joined with the cylindrical liner 14, preferably by a weld joint 36, to prevent intermixing of the primary and secondary fluids within the chamber. The spherical tube sheet 34 is also secured by means of the weld joint 36 to an annular mounting 38 anchored in the reactor vessel 12. The spherical tube sheet 34 provides primary structural support for the heat exchanger 10, most of the components for the heat exchanger being suspended or arranged beneath the spherical tube sheet. The spherical tube sheet 34, the mounting 38 providing primary structural support and the joint or seal 36 are located between the chamber portions 40 and 42, where the primary and secondary fluids are relatively cool, thus enhancing their structural integrity.

As indicated above, the spherical tube sheet 34 divides the cylindrical chamber 18 into two portions, one portion 40 extending throughout most of the length of the chamber 18 for receiving primary helium from the primary inlet 20. Another chamber portion 42 is formed above the spherical tube sheet 34 for receiving secondary fluid or helium from the secondary inlet 24. As may be best seen in FIG. 1, the convex projection of the spherical tube face faces the primary chamber portion 40. As will be made apparent below, this helps to assure containment of the primary helium within the loop including the reactor core (not shown) and the primary chamber portion 40, for example, when the secondary chamber portion is depressurized.

Primary helium is circulated into the chamber 18 through a lower inlet 19 with the primary helium being exhausted or exiting from the chamber 18 through a radially arranged outlet passage 22. Cooled primary helium passes through the outlet passage 22 and a circulator means (not shown) and returns to the chamber 18 through a passage 20. The returning primary helium passes downwardly through an annular passage formed between the liner 14 and a shroud 46 into an annular region surrounding the passage 19 for communication to a heat source, for example, the nuclear reactor core. The liner 14 of the chamber 18 is thus not exposed to the very high primary helium inlet temperatures.

Means for circulating the secondary helium into and out of the heat exchanger chamber 18 is arranged at one axial end thereof. Preferably, coaxial inlet and outlet secondary helium passages 24 and 26 are formed by concentric tubular members 28 and 30. The outer tubular members 28 are supported relative to the cylindrical liner 14 by means of a fabricated structure 32 which also serves to enclose or seal the upper end of the cylindrical chamber 18.

The heat exchanger 10 also includes a tube bundle 44 which comprises a particularly important feature of the present invention. The central tubular member 30 penetrates the spherical tube sheet 34 in sealed relation and extends downwardly through the primary chamber portion 40 to form a return duct for receiving secondary helium from the tube bundle 44. At the same time, the spherical tube sheet 34 provides a manifold means for communicating the secondary helium to the tube bundle in a manner also described in greater detail below.

It may be best seen from FIG. 1 that both the cooled primary helium circulator inlet and outlet passages 22 and 20 are arranged toward the upper end of the cylindrical liner 14. In order to assure a proper flow of the cooled primary helium along the cylindrical liner 14 and to provide attachments for gas seals 96 and 98 around the tube bundle 44, the cylindrical shroud 46 is secured in sealed relation to the cylindrical liner 14 at 15 between the inlet and outlet passages 20 and 22, an additional mounting 48 being anchored in the reactor vessel. The shroud 46 is annularly spaced apart from the cylindrical liner 14 to form a passage for communicating cooled primary helium from the inlet passage 20 toward the base of the cylindrical chamber 18 and through the annular region about the passage 19 to the heat source. The lower end 50 of the shroud 46 forms a reduced opening through which the heated primary helium is again directed upwardly from the heat source through the passage 19 toward the tube bundle 44.

Figure 3:
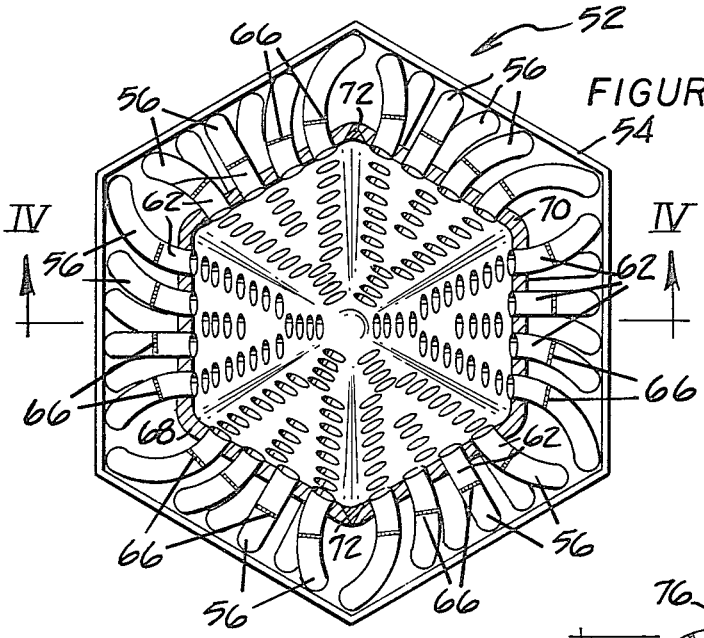
FIG. 3 is a sectioned view taken across one end of one module in a tube bundle of the heat exchanger of FIG. 1.
Figure 4:
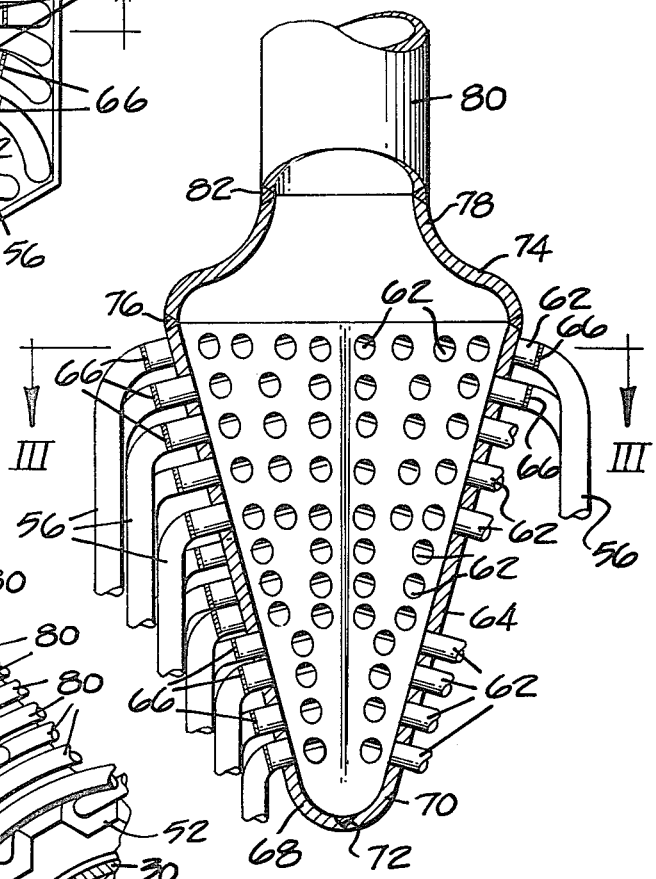
FIG. 4 is an axially sectioned, fragmentary view of a header and a number of tubes at one end of a module in such a tube bundle.
Figure 2:
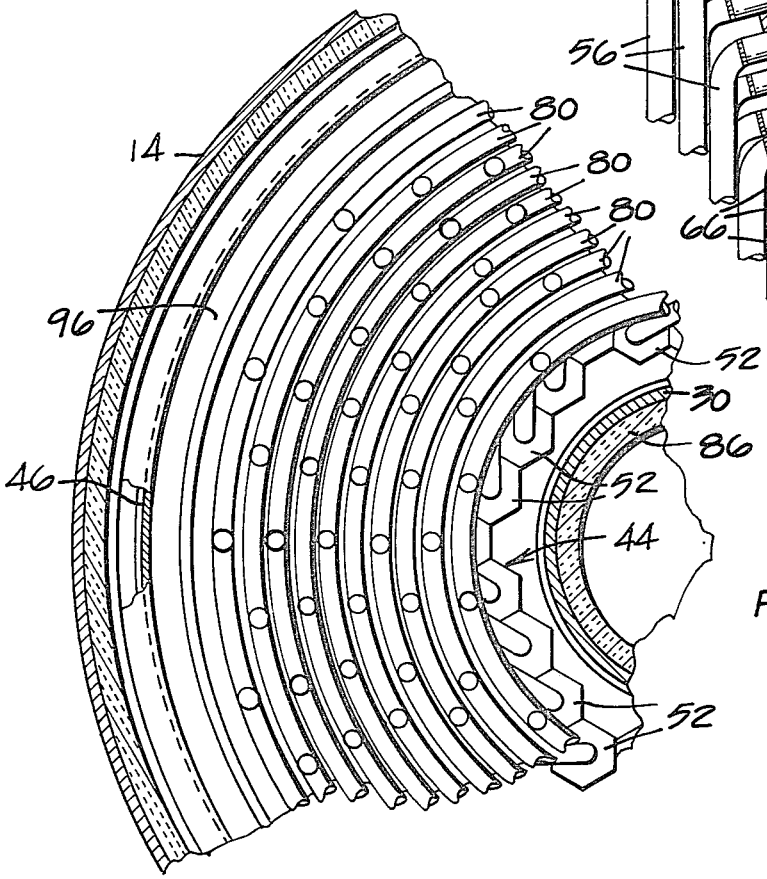
FIG. 2 is a view taken along section line II—II of FIG. 1.

The arrangement and construction of the tube bundle 44 may be better seen by combined reference to FIGS. 1 and 2. The tube bundle 44 comprises a large number of modules 52 arranged in a clustered annular configuration surrounding the central duct 30. Referring momentarily to FIGS. 3 and 4, each module 52 includes an outer shroud 54 which has a hexagonal shape in cross section. A multiplicity of thermally conductive tubes 56 extends through each of the modules with the opposite ends of the tubes 56 being connected with inlet and outlet headers indicated respectively at 58 and 60 (see FIG. 1). Each of the headers 58 and 60 is formed as a hexagonally shaped pyramid having its apex directed toward the respective module shroud 54. The extending end of each of the headers 58 and 60 tapers to a tubular shape as best seen in FIG. 4 to permit appropriate manifold connections with the respective headers.

Referring particularly to FIG. 4, a large number of tubular stub shafts 62 are secured along the length of the pyramidal portion 64. Preferably, the stub shafts 62 are integrally joined to the pyramidal header portion 64 either by being machined thereon or intimately secured to the header portion. The stub shaft 62 may be secured to the respective tubes 56 for example by means of weld joints indicated at 66. The weld joints 66 may be formed from either inside or outside of the stub shafts to facilitate interconnection of each header with a large number of tubes. It is particularly contemplated for example that each of the modules 52 include approximately (169) of the tubes 56 with each of the tubes being connected between an inlet header 58 and an outlet header 60 arranged at opposite ends of the module. Thus, it is particularly important that an efficient and effective means for welding the tubes 56 to each of the headers be provided.

Referring again to FIG. 4, the pyramidal portion 64 of each header is preferably formed by joining together two tube sheet halves 68 and 70 by means of a weld joint indicated at 72 (also see FIG. 3). A transitional header portion 74 is secured to the fabricated pyramidal header portion 64 by a weld joint indicated at 76. The transition header portion 74 tapers from the above noted hexagonal shape formed in cross section along the weld joint 76 to a tubular configuration indicated at 78 for facilitating interconnection of each of the inlet headers 58 with an inlet lead tube 80 by means of a weld joint 82.

Referring to FIG. 1, it may be seen that each of the outlet headers 60 is similarly formed and provides an interconnection with respective outlet lead tubes 84.

Continuing with reference to FIG. 1, it is contemplated that approximately (162) of the heat exchanger modules 52 are employed to form the tube bundle 44. The hexagonal configuration of the modules permits them to be nested together so that longitudinal flow of the primary helium is directed through the interior or tube containing portions of the modules. Preferably, the hexagonal shroud 54 for each of the modules 52 is formed from a open or porous material to promote cross-flow of the primary helium between adjacent modules. Cross-flow in this manner tends to promote uniform thermal performance within all of the modules while also minimizing or reducing overheating of any module through which coolant or secondary helium is not flowing.

Referring to FIGS. 1 and 2 in combination, the inlet lead tubes 80 are formed with spiral configurations and extend upwardly for sealed interconnection with the spherical tube sheet 34. An interconnection for each of the inlet lead tubes 80 with the spherical tube sheet 34 may be formed for example by means of stub shafts and weld joints of the type described above for each of the module headers. The spherical configuration for the inlet lead tubes 80 contributes additional longitudinal flexibility between the spherical tube sheet 34 and the tube bundle 44 to accommodate differential thermal expansion along the length of the heat exchanger. The inlet lead tubes 80 are located in the cooled primary helium atmosphere and contain cool inlet secondary helium during operation so that their operating temperature is relatively low, a factor which enhances their durability when being deformed to provide longitudinal contraction and expansion of the tube bundle assembly 44.

The inlet lead tubes 80 thus connect the respective inlet headers 58 with a secondary helium manifold means provided by the spherical tube sheet 34. As indicated above, the central duct 30 which extends through the tube bundle 44 provides a return passage for receiving high temperature secondary helium from the outlet headers 60 at the lower end of the tube bundle.

In addition, the central duct 30 is structurally secured to the spherical tube sheet 34 while being otherwise substantially unsupported along its length through the primary chamber portion 40. As will be described in greater detail below, the center duct 30 also serves as a central load carrying member for the intermediate heat exchanger 10 and particularly for the tube bundle 44. In this manner, longitudinal expansion and contraction of the center duct 30 and the tube bundle is accommodated in substantially unrestrained relation.

In order to further adapt the center duct for thermal expansion and contraction together with the tube bundle 44, the center duct 30 has insulation 86 arranged internally substantially along its length through the tube bundle 44. In this manner, thermal expansion and contraction of that portion of the center duct 30 which extends through the tube bundle tends to conform to thermal expansion and contraction of the tube bundle itself since they experience a similar temperature environment.

The lower end 88 of the center duct 30 is closed while a cylindrical portion 90 of the duct immediately thereabove provides a tube sheet permitting a manifold interconnection with the various outlet lead tubes 84. Here again, the various outlet lead tubes 84 may be secured to the cylindrical tube sheet 90 for example by means of integral stub shafts and weld joints of the type described above in connection with the header construction best illustrated in FIG. 4.

During operation of the heat exchanger, the lower end of the tube bundle experiences a substantially higher temperature than its upper end. Accordingly, the lower or outlet lead tubes 84 which are curved for interconnection with the tubular sheet 90 tend to be relatively weak structures within the high surrounding temperatures. In order to provide additional structural support for the outlet lead tubes 84, a reinforced support plate 92 is secured to the center duct 30 and extends outwardly to form openings for receiving and supporting the respective outlet lead tubes 84. In order to provide additional protection for the outlet lead tubes 84, a spherical shield or deflector 94 is arranged about the outlet lead tubes 84 to deflect the upward flow of primary helium and dissipate its force before entering the tube bundle.

Upper and lower annular seal assemblies are arranged between the tube bundle 44 an the shroud 46 and also between the tube bundle 44 and the center duct 30 in order to assure that the primary helium flows through the interiors of the various tube modules 52. The upper and lower seal assemblies between the tube bundle and the shroud 46 are indicated respectively at 96 and 98. Similarly, upper and lower seal assemblies arranged between the tube bundle 44 and the center duct 30 are indicated respectively at 102 and 104. The upper seal assembly 102 allows controlled gas leakage to assure uniform heating of the center duct 30. Efficiency of the heat exchanger is of course increased by use of the seal assemblies 96, 98, 102 and 104 since they direct flow of the primary helium through the tube bundle module to increase heat exchange contact with the tubes 56. Portions of the module shrouds 54 are non-porous to further assure proper flow of the primary helium. Module shroud portions at the outer periphery of the tube bundle 44 are non-porous between the seal assemblies 96 and 98. Similarly, module shroud portions at the inner periphery of the tube bundle 44 are non-porous below the lower seal assembly 104 to prevent hot inlet primary helium flow along the lower end portion of the center duct 30.

No gas flow seals are required between adjacent modules 52 because of the close nesting assembly made possible by their hexagonal configurations.

The mode of operation for the heat exchanger 10 is believed obvious from the preceding description. However, to again summarize its mode of operation, the cooled primary helium enters the primary portion 40 of the cylindrical chamber 18 through the inlet passage 20 and flows downwardly between the cylindrical liner 14 and the shroud 46. At the bottom of the chamber 18, the primary helium is circulated to the heat source and then returned through the inlet duct 19 from which it is directed upwardly and deflected or modulated by the shield 94 before passing through the various modules 52 of the tube bundle 44. Flow of the primary helium is of course limited to the shell side or exterior of the tube bundle. As the primary helium exits the upper ends of the modules 52 in the tube bundle, it flows through the outlet passage 22 and the abovenoted circulator means which promotes the flow of cooled primary helium into the inlet passage 20 and out of the outlet passage 22.

At the same time, secondary fluid or helium enters the secondary portion 42 of the cylindrical chamber 18 through the secondary annular inlet passage 24. Secondary helium from the secondary chamber portion 42 enters the upper or inlet lead tubes 80 for distribution to the inlet headers 58 in the respective modules. The headers 58 in turn distribute the flow of secondary fluid through the large number of thermally conductive tubes 56. During passage of the secondary helium through the tubes 56, it is heated substantially by heat exchange with the primary helium which is simultaneously cooled before passing to the outlet passage 22. After passage through the tubes 56, the secondary helium enters the outlet headers 60 where it is directed through the lower or outlet lead tubes 84 into the lower end of the center duct 30. The heated secondary helium then flows upwardly through the center duct 30 to the secondary outlet 26. The internal insulation 86 within the center duct 30 also serves to prevent thermal loss from the heated secondary helium as it flows upwardly toward the secondary outlet 26.

As indicated above, thermal expansion and contraction for the tube bundle 44 is accommodated while providing effective support for its modules 52 through the structural function of the center duct 30. Since the lower end of the center duct is unrestrained and insulated to experience substantially the same temperature as the tube bundle, the center duct and tube bundle tend to experience similar longitudinal expansion and contraction. This particularly protects various portions of the heat exchanger, particularly the lower or outlet lead tube 84 from undesirable stresses due to thermal expansion and contraction.

An additional operation feature is made possible by the construction of the heat exchanger 10 as was briefly referred to above. At times, it is desirable for various reasons to plug either the inlet or outlet lead tubes for one or more of the modules in the tube bundles. The construction of the present heat exchanger permits ready access to both the inlet and outlet lead tubes. At the same time, such access is possible while assuring containment of the primary helium within the primary chamber portion 40. For example, the fabricated structure 32 may be removed from the upper end of the cylindrical chamber 18 to provide open access into the secondary chamber portion 42. At the same time, containment of the high pressure primary helium within the primary chamber portion 40, is assured by the spherical tube sheet 34. Ready access is thus provided for the upper or inlet lead tubes 80 which are connected directly with the spherical tube sheet 34. At the same time, access to the lower or outlet lead tubes 84 is also possible through the large diameter of the center duct 30. For example, through the use of special tools or the like extending downwardly through the center shaft, ready access is possible to the cylindrical tube sheet 90 and to each of the outlet lead tubes 84.

It may therefore be seen that the present invention provides an improved modular tube bundle for use within heat exchangers of the type described above. In particular, respective modules such as those indicated at 52 and formed with hexagonal configurations in cross-section may be separately constructed for assembly into a tube bundle such as that indicated at 44. Use of the relatively large center duct 30 and the spherical tube sheet 34 permits access to both the inlet and outlet lead tubes for the tube bundle without disturbing or permitting escape of the primary helium contained within the primary chamber portion 40. The unsupported or cantilevered extension of the center duct 30 through the primary chamber portion 40 to provide a structural support for the tube bundle contributes to effective operation of the heat exchanger particularly under high temperature conditions. This is achieved since thermal expansion and contraction of the tube bundle tends to be accommodated by similar expansion and contraction of the internally insulated center duct 30. In addition, thermal expansion and contraction is accommodated by the coiled upper lead tubes 80 which are located, along with the primary structural support 38 and seals 36, in relatively cool fluid regions.

Various modifications and alterations in addition to those shown and described herein are believed apparent from the preceding description. Accordingly, the scope of the present invention is not limited to the preceding embodiment but is defined only by the following appended claims.

What is claimed is:

1. A heat exchange element for permitting heat exchange between relatively high and low temperature fluids comprising, a modular, elongated heat exchanger tube bundle, including a plurality of elongated shrouds each having a hexagonal configuration in cross-section permitting said shrouds to be clustered into a substantially continuous assembly, a plurality of thermally conductive tubes arranged in each shroud, and inlet and outlet headers respectively associated with each shroud and in communication with said tubes in said shroud, each of said inlet and outlet headers being formed with a pyramidal portion having separate means for connection with each of said thermally conductive tubes, an inlet manifold means in communication with said inlet headers, an outlet manifold means in communication with said outlet headers, each of said inlet and outlet headers further comprising a transition portion for interconnecting said pyramidal portion with a tubular portion suitable for interconnection with one of said inlet and outlet manifold means, means for communicating a first fluid to said inlet manifold means and for reciving said first fluid from said outlet manifold means, and means for causing circulation of a second fluid along said clustered assembly of shrouds for intimate heat exchange with said thermally conductive tubes.

2. The heat exchange element of claim 1 wherein each of said plurality of elongated shrouds is formed from an open material for promoting cross-flow of the second fluid between the clustered shrouds.

3. The heat exchange element of claim 1 further comprising an inlet lead tube for interconnecting the tubular portion of each of said inlet and outlet headers with said inlet manifold means, said inlet manifold means being spherically shaped and extending transversely above said tube bundle, said inlet lead tubes each extending in downwardly supported relation from said spherical inlet manifold and having a helical configuration to accommodate longitudinal movement between said tube bundle and said inlet manifold means.

4. A heat exchange element for permitting heat exchange between relatively high and low temperature fluids, comprising a modular, elongated heat exchanger tube bundle, including a plurality of elongated shrouds each having a hexagonal configuration in cross-section permitting said shrouds to be clustered into a substantially continuous assembly, a plurality of thermally conductive tubes arranged in each shroud, and inlet and outlet headers respectively associated with each shroud and in communication with said tubes in said shroud, an inlet manifold means in communication with said inlet headers, an outlet manifold means in communication with said outlet headers, means for communicating a first fluid to said inlet manifold means and for receiving said first fluid from said outlet manifold means, means for causing circulation of a second fluid along said clustered assembly of shrouds for intimate heat exchange with said thermally conductive tubes, and further comprising an inlet lead tube for interconnecting each of said inlet headers with said inlet manifold means, said inlet manifold being spherically shaped and extending transversely above said tube bundle, said inlet lead tubes each extending in downwardly supporting relation from said spherical inlet manifold and having a helical configuration for accommodating relative movement between said tube bundle and said inlet manifold means.

5. An elongated heat exchange module suitable for clustered assembly with a plurality of similar modules to form a heat exchange element for permitting heat exchange between relatively high and low temperature fluids, comprising an elongated shroud having a hexagonal configuration in cross-section to facilitate nesting of a plurality of said modules into a stack, a pluraltiy of thermally conductive tubes arranged in said shroud and extending along the length thereof, an inlet header arranged at one end of said shroud for communication with one end of each of said tubes, and an outlet header arranged at the opposite end of each shroud for communication with the other end of each of said tubes, said inlet and outlet headers each including means for respective interconnection with inlet and outlet manifold means suitable for circulating a fluid through said tubes arranged in a clustered assembly of said shrouds, each of said inlet and outlet headers being formed with a pyramidal portion having separate means for connection with each of said thermally conductive tubes, each of said inlet and outlet headers also comprising a transition portion for interconnecting said pyramidal portion with a tubular portion interconnected with one of said inlet and outlet manifold means.

6. The elongated heat exchange module of claim 5 wherein said elongated shroud is formed from an open material for promoting cross-flow of one of the fluids between adjacent shrouds in the clustered assembly.

7. A heat exchanger for permitting heat exchange between relatively high and low temperature fluids, comprising an elongated chamber, means for causing a flow of a first fluid through said elongated chamber, inlet and outlet means for a second fluid both being arranged at one end of said elongated chamber, an elongated tubular duct mounted at said one end of said chamber and extending in otherwise unsupported relation into said elongated chamber, a multiplicity of thermally conductive tubes being arranged in a clustered assembly about said tubular duct, each of said multiplicity of tubes having one end adjacent said one end of said chamber and the other end adjacent an extending end of said tubular duct, manifold means interconnecting said one end of each of said tubes with one of said second fluid inlet and outlet means, manifold means interconnecting the other end of each of said tubes with the extending end of said tubular duct, and comprising a cylindrical tube sheet forming an extending end portion of said tubular duct, said cylindrical tube sheet interconnecting said tubes with said tubular duct said manifold means at said one end of said tubes being spherically shaped and extending transversely across the elongated chamber above said clustered assembly of tubes, means interconnecting said tubular duct with the other of said second fluid inlet and outlet means, and further comprising internal insulation arranged along said tubular duct substantially along the length of said multiplicity of tubes so that thermal expansion and contraction of said tubular duct tends to conform with thermal expansion and contraction of said multiplicity of thermally conductive tubes.

8. The heat exchanger of claim 7 further comprising a support plate secured to the extending end of said tubular duct, said support plate forming a multiplicity of openings, outlet lead tubes for interconnecting said multiplicity of thermally conductive tubes with said cylindrical tube sheet extending through said openings and being supported by said support plate.

9. The heat exchanger of claim 8 further comprising shield means for deflecting the first fluid from direct impingement upon said outlet lead tubes.

10. The heat exchanger of claim 9 wherein said multiplicity of thermally conductive tubes is formed by a plurality of nested modules each including a multiplicity of said thermally conductive tubes in communication with an outlet header for each module, each said outlet header being connected with one of said outlet lead tubes.

11. The heat exchanger of claim 10 wherein each module also includes an inlet header similarly in communication with each of said multiplicity of thermally conductive tubes in said respective module and further comprising inlet lead tubes in respective communication with said inlet headers.

12. The heat exchanger of claim 7 wherein said multiplicity of thermally conductive tubes is formed by a plurality of modules each including a hexagonally shaped shroud containing a multiplicity of said thermally conductive tubes with inlet and outlet headers for connecting the thermally conductive tubes of each module with said respective manifold means.

13. A heat exchanger for use in an elongated cylindrical chamber providing access at one end thereof to permit heat exchange between a relatively high temperature primary fluid and a relatively low temperature secondary fluid for removing heat from the heat exchanger, comprising inlet and outlet means in communication with said cylindrical chamber for circulating the primary fluid therethrough, a spherical tube sheet arranged in sealed relation across said one accessible end of the cylindrical chamber to divide the elongated chamber into a relatively large portion for containing the primary fluid and a relatively small portion at said one end for containing the secondary fluid, said tube sheet having a multiplicity of tube ports and a relatively large center opening, a relatively large duct means being arranged in sealed relation within said center opening and extending into said large chamber portion, an end of said duct means extending into said large chamber portion forming a multiplicity of tube ports, a heat exchanger tube bundle being arranged in said large chamber portion and interconnected between the tube ports on said spherical tube sheet at the upper end of the tube bundle and the tube ports on the extending end of said duct means at the lower end of the tube bundle, and inlet and outlet means for said secondary fluid, one of said secondary inlet and outlet means being in communication with said duct means, the other of said secondary inlet and outlet means being in communication with said tube ports for circulating the secondary fluid through said tube bundle.

14. The heat exchanger of claim 13 wherein said multiplicity of thermally conductive tubes is formed by a plurality of nested modules each including a multiplicity of said thermally conductive tubes in communication with an outlet header for each module, each said outlet header being connected with one of said outlet lead tubes.

15. The heat exchanger of claim 14 wherein each module also includes an inlet header similarly in communication with each of said multiplicity of thermally conductive tubes in said respective module and further comprising inlet lead tubes in respective communication with said inlet headers.

16. The heat exchanger of claim 13 wherein said multiplicity of thermally conductive tubes is formed by a plurality of modules each including a hexagonally shaped shroud containing a multiplicity of said thermally conductive tubes with inlet and outlet headers for connecting the thermally conductive tubes of each module with said respective manifold means.

* * * * *